US008138664B2

(12) United States Patent
Cushman et al.

(10) Patent No.: US 8,138,664 B2
(45) Date of Patent: Mar. 20, 2012

(54) BI-SILICATE MATRIX COATING FOR A DISPLAY

(75) Inventors: Barry Michael Cushman, Lancaster, PA (US); David Paul Ciampa, Lancaster, PA (US); James Francis Edwards, Lancaster, PA (US)

(73) Assignee: Thomson Licensing, Boulogne-Billancourt (FR)

( * ) Notice: Subject to any disclaimer, the term of this patent is extended or adjusted under 35 U.S.C. 154(b) by 144 days.

(21) Appl. No.: 12/308,590

(22) PCT Filed: Jun. 21, 2006

(86) PCT No.: PCT/US2006/024220

§ 371 (c)(1),
(2), (4) Date: Dec. 18, 2008

(87) PCT Pub. No.: WO2007/149084

PCT Pub. Date: Dec. 27, 2007

(65) Prior Publication Data

US 2010/0231117 A1 Sep. 16, 2010

(51) Int. Cl.
*H01J 29/10* (2006.01)

(52) U.S. Cl. ..... 313/461; 313/466

(58) Field of Classification Search ..... 313/463, 313/467, 473, 461, 466

See application file for complete search history.

(56) References Cited

U.S. PATENT DOCUMENTS

| | | | | |
|---|---|---|---|---|
| 3,998,638 | A | 12/1976 | Griswold et al. | |
| 4,188,564 | A | 2/1980 | Zegers et al. | |
| 4,380,715 | A | 4/1983 | Postma | |
| 4,473,772 | A | 9/1984 | de Keijzer | |
| 5,885,669 | A | 3/1999 | Morgans et al. | |
| 6,224,730 | B1 | 5/2001 | Rasmussen | |
| 6,296,750 | B1 | 10/2001 | Rasmussen | |
| 2003/0230966 | A1 | 12/2003 | Ozawa | |
| 2004/0058613 | A1 | 3/2004 | Hofmann et al. | |
| 2009/0251042 | A1 * | 10/2009 | Cushman | 313/461 |

FOREIGN PATENT DOCUMENTS

| | | | |
|---|---|---|---|
| CN | 1208181 | A | 2/1999 |

OTHER PUBLICATIONS

Supplementary European Search Report dated May 27, 2008.
International Search Report, dated Oct. 23, 2006.

* cited by examiner

*Primary Examiner* — Vip Patel
(74) *Attorney, Agent, or Firm* — Robert D. Shedd; Harvey D. Fried; Patricia Verlangieri

(57) ABSTRACT

A display screen of a color display is disclosed (see FIG. 1). The display screen includes a glass plate having an array of three different color-emitting phosphors thereon. A graphite-based matrix is placed in the interstitial regions between each of the three different color-emitting phosphors. The graphite-based matrix is formed from an aqueous composition including graphite, potassium silicate and sodium silicate.

9 Claims, 3 Drawing Sheets

BI-SILICATE MATRIX COATING FOR A DISPLAY

This application claims the benefit, under 35 U.S.C. §365 of International Application PCT/US2006/24220, filed on Jun. 21, 2006, which was published in accordance with PCT Article 21(2) on Dec. 27, 2007, in English.

FIELD OF THE INVENTION

This invention relates to a color display and, more particularly to a color display having phosphor deposits on a faceplate panel.

BACKGROUND OF THE INVENTION

Many color displays, such as, for example, color cathode-ray tubes (CRTs) and field emission devices (FEDs) typically include display screens. The display screens are formed from glass plates coated with an array of three different color-emitting phosphors. To provide contrast, a graphite-based matrix is placed in the interstitial regions between each of the three different color-emitting phosphors.

Many graphite-based matrix compositions lose adherence to glass and exhibits weak internal strength when physical contact is made thereto. During assembly of filed emission devices, spacers are placed in contact with the graphite-based matrix composition. Because of the weakness of the graphite matrix coating, adhesive failure may occur primarily at the coating/glass interface, such that the spacers may fall over. Adhesive failure may also occur within the body of the graphite-based matrix composition causing it to come away from the display screen.

Thus, a need exists for a graphite-based matrix composition with improved adhesion to a glass display screen.

SUMMARY OF THE INVENTION

The present invention relates to a display screen of a color display. The display screen includes a glass plate having an array of three different color-emitting phosphors thereon. A graphite-based matrix is placed in the interstitial regions between each of the three different color-emitting phosphors. The graphite-based matrix is formed from an aqueous composition including graphite, potassium silicate and sodium silicate.

BRIEF DESCRIPTION OF THE DRAWING

A preferred implementation of the principles of the present invention will now be described in greater detail, with relation to the accompanying drawings, in which.

DETAILED DESCRIPTION

Figure 1:
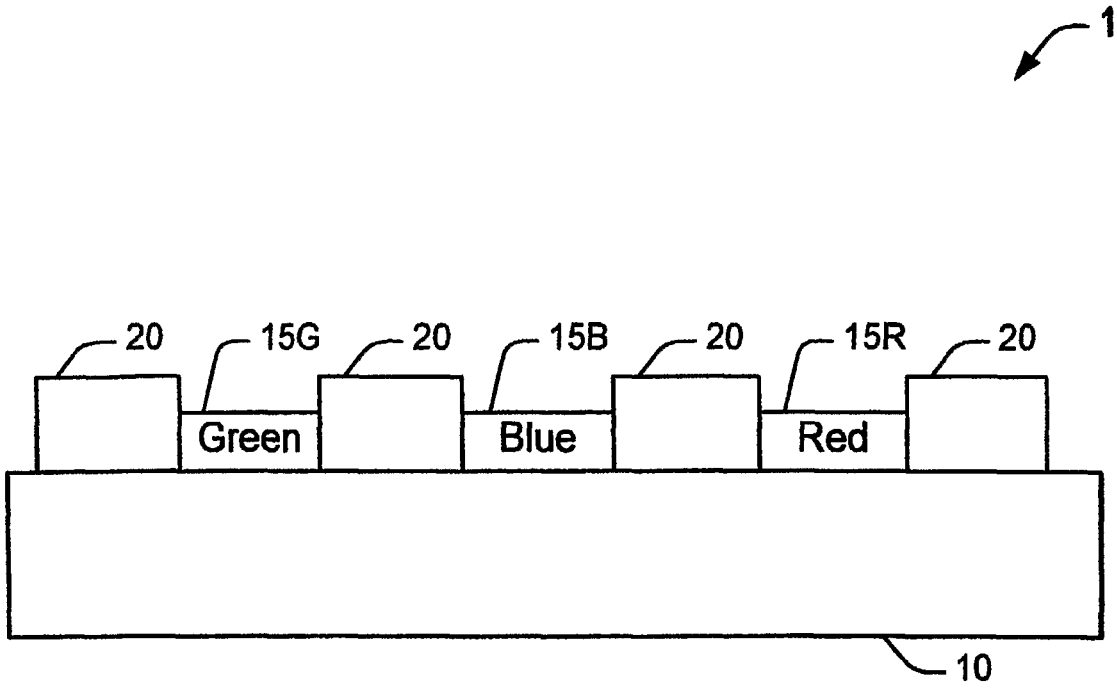
FIG. 1 is a side view of a portion of a display screen of a color display including a graphite-based matrix of the present invention.

FIG. 1 shows a side view of a portion of a display screen 1 of a color display. The display screen 1 includes a glass plate 10 having an array of three different color-emitting phosphors

15G, 15B, 15R thereon. A graphite-based matrix 20 is placed in the interstitial regions between each of the three different color-emitting phosphors 15G, 15B, 15R. The exemplary display screen 1 described herein may be a faceplate panel for a color cathode-ray tube (CRT) as well as a field emission display (FEDs), among other display screens.

The graphite-based matrix is formed from an aqueous composition including graphite, potassium silicate and sodium silicate. The addition of a mixed alkali silicate imparts adhesive strength to the graphite-based matrix composition in a two-fold manner. Potassium silicate hardens at room temperature and provides the graphite-based matrix composition with enough strength to survive subsequent processing steps. Sodium silicate hardens during baking (e.g., at 450° C.) so there is good adherence at the coating/glass interface and within the body of the coating during subsequent processing steps. When sodium silicate is the only alkali silicate in the graphite-based matrix composition, the graphite-based matrix composition washes off the glass during subsequent processing steps. When potassium silicate is the only alkali silicate in the graphite-based matrix composition, the graphite-based matrix composition does not have enough adhesive strength to survive subsequent processing steps.

The potassium silicate and sodium silicate may be present in the aqueous composition in a ratio of about 1:1 to about 5:1 sodium silicate to potassium silicate. Further, the aqueous composition should preferably include up to 10% by weight sodium silicate and potassium silicate.

EXAMPLE 1

An exemplary aqueous graphite-based matrix solution is formed by mixing 14.4 grams of Kasil 2135 potassium silicate (commercially available from PQ Corporation, Valley Forge, Pa.), 9.4 grams of J sodium silicate (commercially available from PQ Corporation, Valley Forge, Pa.), 100 grams Electrodag 1530 graphite dispersion (commercially available from Acheson Colloids Company, Port Huron, Mich.) and in 128.9 grams of deionized water. The aqueous graphite-based matrix solution is further mixed on a jar roller for more than about 30 minutes. After mixing the graphite-based matrix composition should be applied to a display screen within about 24 hours to avoid agglomeration.

A coating formed from the graphite-based matrix composition of Example 1 was tested for adhesion. No failure occurred at the glass/coating interface or within the body of the coating.

EXAMPLE 2

An exemplary aqueous graphite-based matrix solution is formed by mixing 8.1 grams of Kasil 2135 potassium silicate (commercially available from PQ Corporation, Valley Forge, Pa.), 5.25 grams of J sodium silicate (commercially available from PQ Corporation, Valley Forge, Pa.), 100 grams Electrodag 1530 graphite dispersion (commercially available from Acheson Colloids Company, Port Huron, Mich.) and in 83.75 grams of deionized water. The aqueous graphite-based matrix solution is further mixed on a jar roller for more than about 30 minutes. After mixing the graphite-based matrix composition should be applied to a display screen within about 24 hours to avoid agglomeration.

A coating formed from the graphite-based matrix composition of Example 2 was tested for adhesion. No failure occurred at the glass/coating interface or within the body of the coating.

EXAMPLE 3

An exemplary aqueous graphite-based matrix solution is formed by mixing 5.84 grams of Kasil 2135 potassium silicate (commercially available from PQ Corporation, Valley Forge, Pa.), 11.98 grams of J sodium silicate (commercially available from PQ Corporation, Valley Forge, Pa.), 100 grams Electrodag 1530 graphite dispersion (commercially available from Acheson Colloids Company, Port Huron, Mich.) and in 111.31 grams of deionized water. The aqueous graphite-based matrix solution is further mixed on a jar roller for more than about 30 minutes. After mixing the graphite-based matrix composition should be applied to a display screen within about 24 hours to avoid agglomeration.

A coating formed from the graphite-based matrix composition of Example 3 was tested for adhesion. No failure occurred at the glass/coating interface or within the body of the coating.

EXAMPLE 4

An exemplary aqueous graphite-based matrix solution is formed by mixing 3.9 grams of Kasil 2135 potassium silicate (commercially available from PQ Corporation, Valley Forge, Pa.), 12.6 grams of J sodium silicate (commercially available from PG Corporation, Valley Forge, Pa.), 100 grams Electrodag 1530 graphite dispersion (commercially available from Acheson Colloids Company, Port Huron, Mich.) and in 112.0 grams of deionized water. The aqueous graphite-based matrix solution is further mixed on a jar roller for more than about 30 minutes. After mixing the graphite-based matrix composition should be applied to a display screen within about 24 hours to avoid agglomeration.

A coating formed from the graphite-based matrix composition of Example 4 was tested for adhesion. No failure occurred at the glass/coating interface or within the body of the coating.

Referring to FIG. 2 and FIGS. 3A-3D, the method for forming the graphite-based matrix of the present invention on the display screen of the color display will be described. Initially, the interior surface of the display screen 10 is cleaned, as indicated by reference numeral 100 in FIG. 2 and FIG. 3A, by washing it with a caustic solution, rinsing it in water, etching it with buffered hydrofluoric acid and rinsing it again with water, as is known in the art.

Figure 2:
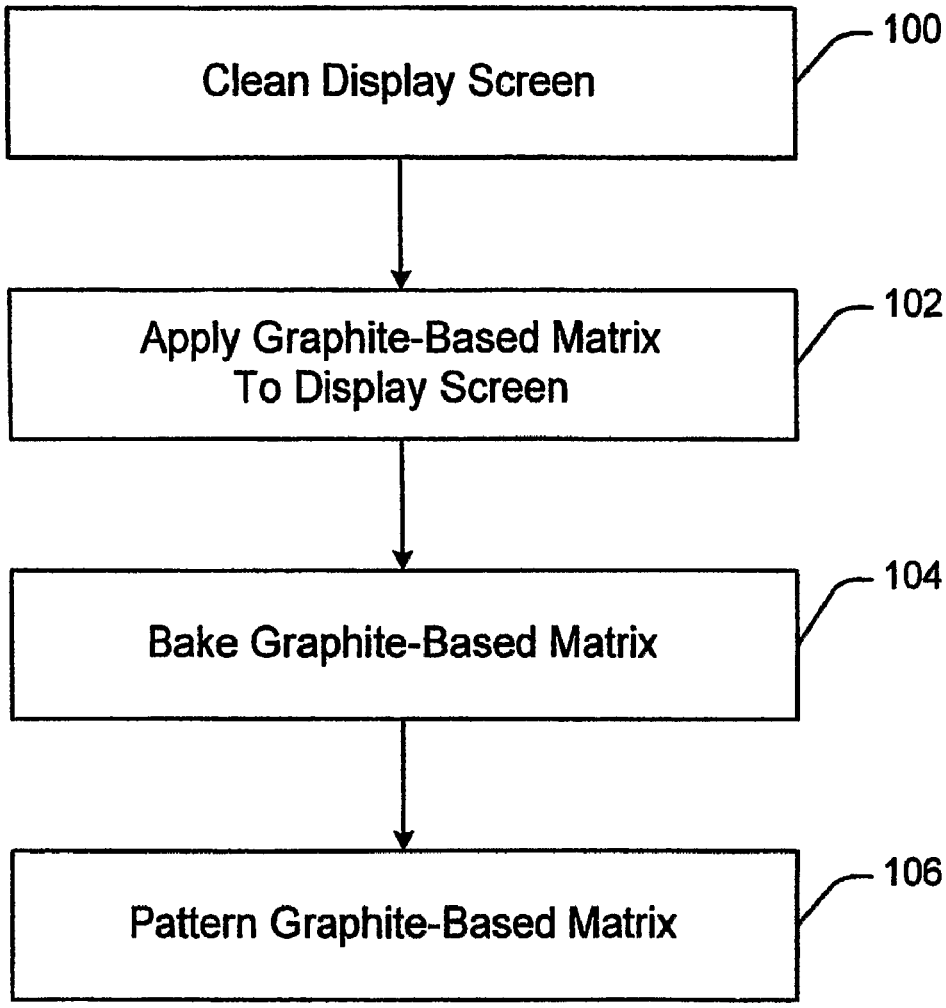
FIG. 2 is flow chart of the process for forming the graphite-based matrix of the present invention on the display screen of the color display.
Figure 3A:
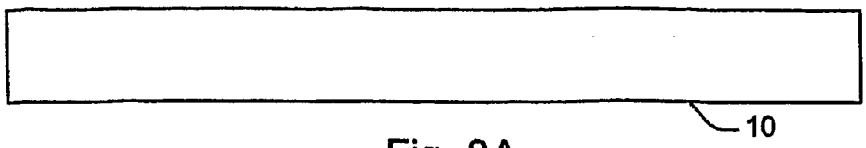
FIGS. 3A-3D depict views of the interior surface of the faceplate panel during formation of the luminescent screen assembly.
Figure 3B:
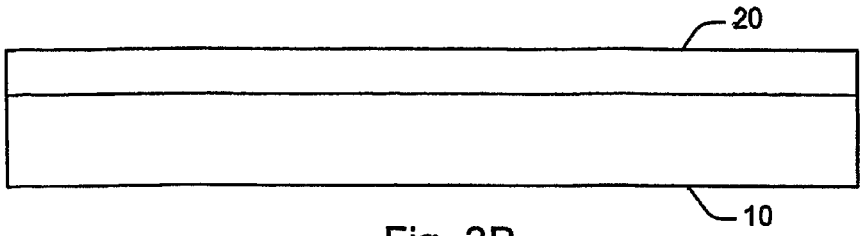

As shown in FIG. 3B, the interior surface of the display screen 10 is then provided with the graphite-based matrix 20, as indicated by reference numeral 102. The graphite-based matrix 20 is uniformly applied over the interior surface of the display screen 10 using for example, a spin coating technique, as is known in the art. The graphite-based matrix preferably has a thickness of about 0.003 inches to about 0.010 inches. As indicated by reference numeral 104 in FIG. 2, after the graphite-based matrix is applied to the display screen 10, the display screen 10 is baked to about 450° C. for about 40 minutes to remove the water therefrom.

Figure 3C:
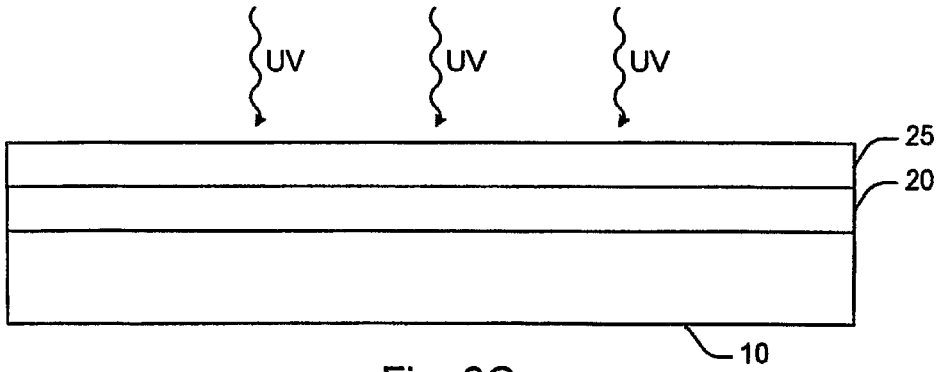
Figure 3D:
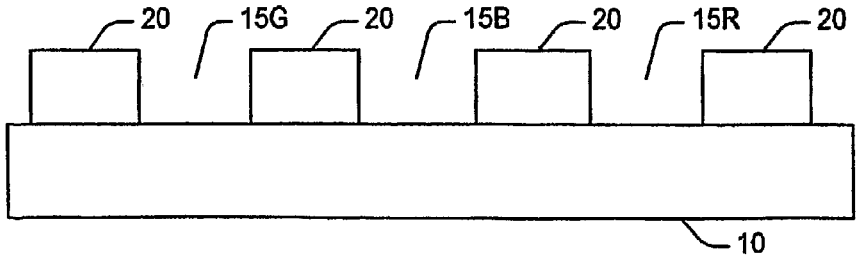

The graphite-based matrix 20 is patterned, as indicated by reference numeral 106 in FIG. 2, to form openings therein within which three different color-emitting phosphors 15G, 15B, 15R (FIG. 1) are deposited. Referring to FIG. 3C, the graphite-based matrix 20 is patterned by depositing a light sensitive material 25 thereon and irradiating portions of such layer to light, such as for example, ultraviolet (UV) light. The light sensitive material 25 is developed using, for example, deionized water. During development, portions of the light sensitive material 25 are removed. Thereafter, as shown in FIG. 3D, portions of the graphite-based matrix 20 are removed in regions where the three different color-emitting phosphors 15G, 15B, 15R are to be subsequently deposited.

The above-described graphite-based matrix composition has improved adherence to the glass of the color display screen. In addition, the graphite-based matrix composition has improved coating strength.

Although an exemplary color display screen for a color cathode-ray tube (CRT) or field emission device (FED) which incorporates the teachings of the present invention has been shown and described in detail herein, those skilled in the art can readily devise many other varied embodiments that still incorporate these teachings.

The invention claimed is:

1. A display, comprising:

a display screen having a patterned light-absorbing matrix composition thereon defining a plurality of sets of fields, wherein the light-absorbing matrix includes graphite, potassium silicate and sodium silicate.

2. The display of claim 1 wherein the potassium silicate and sodium silicate are present in the light-absorbing matrix composition in a ratio of about 1:1 to about 5:1 sodium silicate: potassium.

3. The display of claim 1 wherein the light-absorbing matrix composition includes less than about 10% by weight of potassium silicate and sodium silicate.

4. A cathode-ray tube, comprising:

a display screen having a patterned light-absorbing matrix composition thereon defining a plurality of sets of fields, wherein the light-absorbing matrix includes graphite, potassium silicate and sodium silicate.

5. The cathode-ray tube of claim 4 wherein the potassium silicate and sodium silicate are present in the light-absorbing matrix composition in a ratio of about 1:1 to about 5:1 sodium silicate:potassium.

6. The cathode-ray tube of claim 4 wherein the light-absorbing matrix composition includes less than about 10% by weight of potassium silicate and sodium silicate.

7. A field emission device, comprising:

a display screen having a patterned light-absorbing matrix composition thereon defining a plurality of sets of fields, wherein the light-absorbing matrix includes graphite, potassium silicate and sodium silicate.

8. The field emission device of claim 7 wherein the potassium silicate and sodium silicate are present in the light-absorbing matrix composition in a ratio of about 1:1 to about 5:1 sodium silicate:potassium.

9. The field emission device of claim 7 wherein the light-absorbing matrix composition includes less than about 10% by weight of potassium silicate and sodium silicate.

* * * * *